US009105437B2

(12) United States Patent
Choi et al.

(10) Patent No.: US 9,105,437 B2
(45) Date of Patent: Aug. 11, 2015

(54) FIELD EMISSION X-RAY TUBE AND METHOD OF FOCUSING ELECTRON BEAM USING THE SAME

(71) Applicant: Electronics and Telecommunications Research Institute, Daejeon (KR)

(72) Inventors: Sungyoul Choi, Ulsan (KR); Yoon-Ho Song, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 327 days.

(21) Appl. No.: 13/829,130

(22) Filed: Mar. 14, 2013

(65) Prior Publication Data

US 2013/0336459 A1 Dec. 19, 2013

(30) Foreign Application Priority Data

Jun. 18, 2012 (KR) ..... 10-2012-0064759

(51) Int. Cl.

*H01J 3/14* (2006.01)
*G21K 1/08* (2006.01)
*H01J 35/14* (2006.01)
(Continued)

(52) U.S. Cl.

CPC ..... *H01J 35/065* (2013.01); *H01J 3/14* (2013.01); *H01J 35/14* (2013.01); *H01J 29/481* (2013.01); *H01J 29/488* (2013.01); *H01J 29/51* (2013.01); *H01J 29/58* (2013.01); *H01J 29/82* (2013.01)

(58) Field of Classification Search

CPC ..... G21K 1/08; G21K 1/087; H01J 1/30; H01J 1/304; H01J 1/308; H01J 1/312; H01J 1/46; H01J 1/94; H01J 3/02; H01J 3/021; H01J 3/027; H01J 3/07; H01J 3/10; H01J 3/12; H01J 3/14; H01J 3/18; H01J 3/36; H01J 19/00; H01J 19/02; H01J 19/24; H01J 19/28; H01J 19/38; H01J 19/42; H01J 19/46; H01J 19/48; H01J 21/00; H01J 21/02; H01J 21/06; H01J 21/36; H01J 27/00; H01J 27/02; H01J 27/022; H01J 27/024; H01J 27/26; H01J 29/00; H01J 29/02; H01J 29/024; H01J 29/04; H01J 29/45; H01J 29/456; H01J 29/48; H01J 29/481; H01J 29/488; H01J 29/51; H01J 29/54; H01J 29/56; H01J 29/563; H01J 29/58; H01J 29/62; H01J 29/622; H01J 29/624; H01J 29/70; H01J 29/80; H01J 29/82; H01J 31/00; H01J 33/00; H01J 33/02; H01J 35/00; H01J 35/02; H01J 35/04; H01J 35/045; H01J 35/06; H01J 35/065; H01J 35/14; H01J 35/24; H01J 35/30; H01J 37/063; H01J 37/073; H01J 37/08; H01J 37/10; H01J 37/12; H01J 37/147; H01J 37/1471; H01J 37/00; H01J 37/02; H01J 37/04; H01J 37/06

USPC ..... 378/91, 119, 121, 122, 136, 138, 210; 250/396 R, 423 F, 526; 313/1–5, 359.1, 313/360.1, 361.1, 363.1, 409–412, 414, 313/441, 446, 452–454, 456, 458, 460, 238, 313/310

See application file for complete search history.

(56) References Cited

U.S. PATENT DOCUMENTS

| | | | | |
|---|---|---|---|---|
| 7,348,722 | B2 * | 3/2008 | Ahn et al. | 313/497 |
| 2003/0099327 | A1 * | 5/2003 | Matsushita et al. | 378/138 |
| 2009/0245468 | A1 * | 10/2009 | Zou et al. | 378/122 |

FOREIGN PATENT DOCUMENTS

KR 10-1026863 B1 4/2011

*Primary Examiner* — Anastasia Midkiff

(57) ABSTRACT

Provided is a field emission X-ray tube. The field emission X-ray tube includes a cathode electrode provided on one end of a vacuum container, including a field emission emitter; a gate electrode provided inside the vacuum container to be adjacent to the cathode electrode, including a first opening; a focusing electrode electrically connected to the gate electrode and provided on one surface of the gate electrode to be farther from the cathode electrode than the gate electrode while including a second opening with a greater width than that of the first opening; and an anode electrode provided inside the vacuum container on another end thereof in a direction where the vacuum container is extended. A height of the focusing electrode is identical to the width of the second opening, and wherein the width of the first opening is ⅓ or less of the second opening.

15 Claims, 8 Drawing Sheets

(51) Int. Cl.

| | | | |
|---|---|---|---|
| ***H01J 35/06*** | (2006.01) | *H01J 29/48* | (2006.01) |
| *H01J 29/58* | (2006.01) | *H01J 29/51* | (2006.01) |
| | | *H01J 29/82* | (2006.01) |

FIELD EMISSION X-RAY TUBE AND METHOD OF FOCUSING ELECTRON BEAM USING THE SAME

CROSS-REFERENCE TO RELATED APPLICATIONS

This U.S. non-provisional patent application claims priority under 35 U.S.C. §119 of Korean Patent Application No. 10-2012-0064759, filed on Jun. 18, 2012, the entire contents of which are hereby incorporated by reference.

BACKGROUND OF THE INVENTION

The present invention disclosed herein relates to an X-ray and a method of focusing electronic beams, and more particularly, to a field emission X-ray tube and a method of focusing electronic beams using the same.

X-rays generally used for medical purposes, industrial purposes, and research purposes are obtained by colliding electrons on an anode electrode of a metal target, in which, as an electron source used for this, there are a thermionic source including electron discharge by heating a metallic material and a field emission source using nano materials.

Thermionic sources have a relatively short lifespan, are difficult to reduce a size thereof. Also, since electron discharge is performed as a dipole, it is difficult to control the strength of an X-ray and difficult to perform integration, and miniaturization thereof. On the contrary, in case of field emission sources using nano-materials, it is possible to discharge electrons as triode structures, to have various electric, physical shapes, to generate X-rays with relatively higher outputs than thermionic sources, and to easily perform controlling the strength of X-rays, integration, and miniaturization thereof. There have been many researches to apply field emission sources to industrial defect and quality inspection systems, medical brachytherapy systems, and three-dimensional digital diagnosis system using such merits of field emission sources.

However, there are some limitations on nano-material-based field emission sources in aspect of technologies up to now. When field emission occurs, there is a limitation of present electron beam focusing, which should be priorly solved. As the limitation occurring due to omission of electron beam focusing, there is electric charge accumulation occurring on a sidewall of ceramic used for insulation in such a way that electron beams are not transmitted to an anode electrode, thereby preventing generation of X-rays, an electronic source is damaged and demolished due to arcing, and it is impossible to form focal spots in sizes of micro meter μm or nano-meter nm to obtain an X-ray image with high output and high resolution.

To overcome such limitation, it is needed to provide a gate electrode structure including electron beam focusing of a new concept and to provide a vacuum seaming technology for manufacturing an X-ray generator such as an X-ray tube.

SUMMARY OF THE INVENTION

The present invention provides a field emission X-ray tube preventing electron accumulation simultaneously with forming an electron beam spot with a size of micro meters or less.

The present invention also provides a method of focusing electron beams emitted from a field emission emitter to form an electron beam spot with a size of micro meters or less on an anode electrode.

The provided is not limited to the described above and clearly understood by those skilled in the art from following description.

Embodiments of the present invention provide field emission X-ray tubes including: a cathode electrode provided on one end of a vacuum container, including a field emission emitter; a gate electrode provided inside the vacuum container to be adjacent to the cathode electrode, including a first opening; a focusing electrode electrically connected to the gate electrode and provided on one surface of the gate electrode to be farther from the cathode electrode than the gate electrode while including a second opening with a greater width than that of the first opening; and an anode electrode provided inside the vacuum container on another end thereof in a direction where the vacuum container is extended. A height of the focusing electrode may be identical to the width of the second opening, and the width of the first opening may be ⅓ or less of the second opening.

In some embodiments, the focusing electrode may be in physical contact with the one surface of the gate electrode.

In other embodiments, an outer circumference of the focusing electrode may be smaller than that of the gate electrode.

In still other embodiments, a cross-section of the first opening may be one of a circle and a polygon.

In still other embodiments, the width of the first opening may be greater than a maximum width of a cross-section of the field emission emitter.

In still other embodiments, the first opening may include a shape penetrating the gate electrode.

In still other embodiments, a cross-section of the field emission emitter may be one of a circle and a polygon.

In still other embodiments, a cross-section of the second opening may be one of a circle and a polygon.

In still other embodiments, the second opening may include a shape penetrating the focusing electrode.

In still other embodiments, the field emission emitter may include nano-materials.

In still other embodiments, the anode electrode is inclined with respect to the cathode electrode.

In other embodiments of the present invention, methods of focusing electron beams. The method may include one of controlling the height of the focusing electrode and changing the width of the first opening in the field emission X-ray tube including the configuration described above.

In some embodiments, the method may further include changing a distance between the field emission emitter and the gate electrode.

In other embodiments, the focusing electrode may be in physical contact with the one surface of the gate electrode.

In still other embodiments, the anode electrode may be inclined with respect to the cathode electrode.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
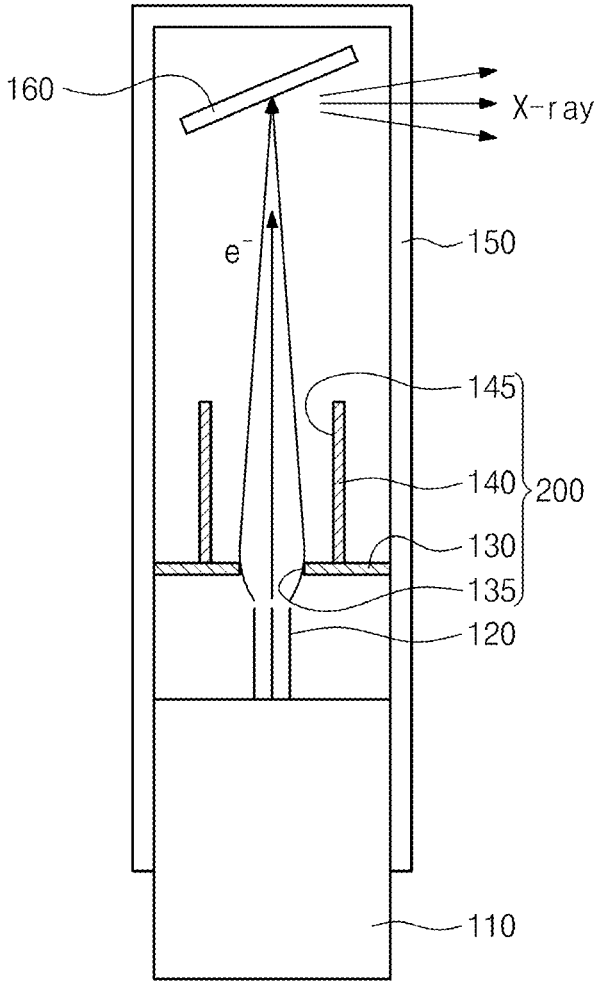
FIG. 1 is a cross-sectional view illustrating a configuration of a field emission X-ray tube according to an embodiment of the present inventive concept.
Figure 2:
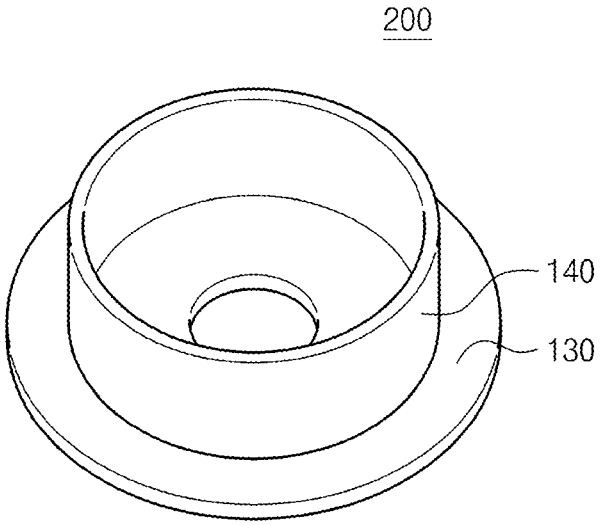
FIGS. 2 to 5 are three-dimensional views illustrating a partial configuration of the field emission X-ray tube according to the present embodiment.
Figure 3:
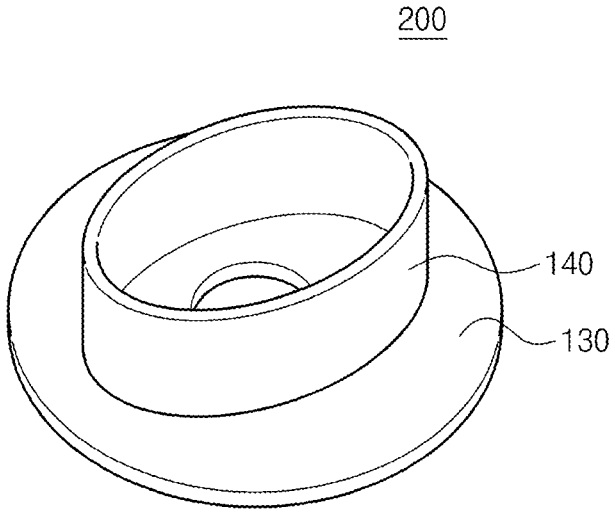
Figure 4:
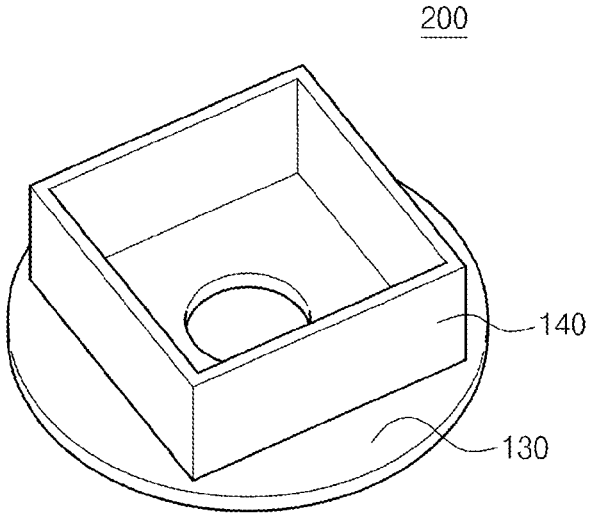
Figure 5:
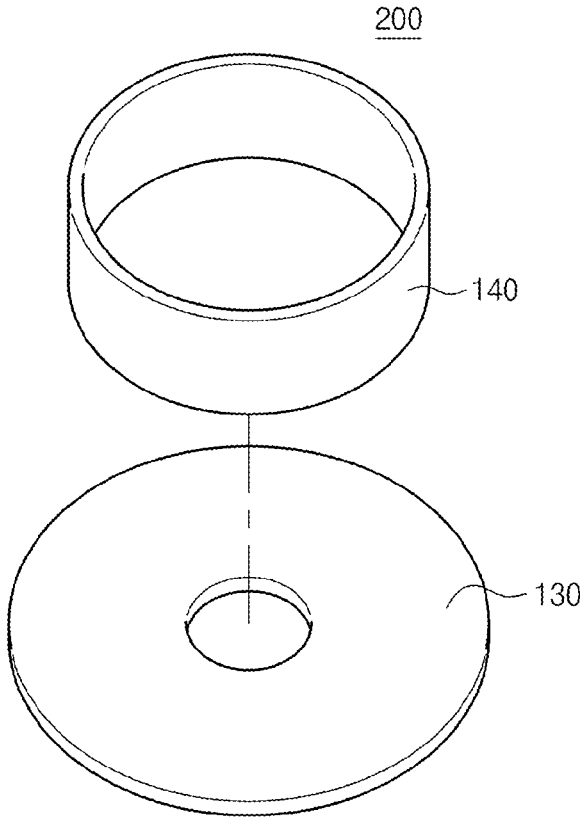

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Like reference numerals refer to like elements throughout.

Terms used in the description are just for describing embodiments but not limit the present inventive concept. In the specification, a singular form includes a plural form if there is no particular mention about it in phrases. Comprises and/or comprising used in the specification do not exclude presence or addition of one or more elements in addition to a mentioned element. Also, since it is according to preferable embodiments thereof, reference numerals mentioned according to a sequence of description are not limited to the sequence. In addition, in the present specification, it will also be understood that when a layer (or film) is referred to as being 'on' another layer or substrate, it can be directly on the other layer or substrate, or intervening layers may also be present.

Embodiments will be described with reference to preferable cross-sectional views and/or top views. In the drawings, the dimensions of layers and regions are exaggerated for clarity of illustration. Accordingly, a formation of an exemplary view may vary with manufacturing technologies and/or an allowable error. Accordingly, the embodiments of the present inventive concept are not limited certain illustrated forms but include variances in shapes generated by a manufacturing process. For example, an etching region illustrated as a right angle may be a shape with a round part or with a curvature. Accordingly, a region illustrated in the drawings has schematic characteristics and shapes of regions illustrated in the drawings are provided just for showing certain forms of the regions of a device, which do not restrict the scope of the present inventive concept.

FIG. 1 is a cross-sectional view illustrating a field emission X-ray tube according to an embodiment of the present inventive concept.

Referring to FIG. 1, the field emission X-ray tube includes a vacuum container 150, a cathode electrode 110 provided on one end of the vacuum container 150 including a field emission emitter 120 emitting electrons e, a gate electrode 130 provided inside the vacuum container 150 to be adjacent to the cathode electrode 110 including a first opening 135, a focusing electrode 140 electrically connected to the gate electrode 130 and provided on one surface of the gate electrode 130 relatively farther from the cathode electrode 110 than the gate electrode 130 while including a second opening 145 having a greater width than the first opening 135, and an anode electrode 160 provided inside the vacuum container 150 on another end portion thereof in a direction in which the vacuum container 150 is extended. Not shown, there may be further included a getter for maintaining and improving a vacuum state of the inside of the vacuum container 150.

Since the anode electrode 160 is inclined toward the cathode electrode 110 with a certain angle, the field emission X-ray tube according to the present embodiment may be a reflective field emission X-ray source. The reflective field emission X-ray source may further include, to emit X-rays generated from the anode electrode 160 outwardly, a window including metallic materials such as beryllium Be and molybdenum Mo. On the contrary, when the anode electrode 160 includes a metallic material and a conductive material such as ceramic, the field emission X-ray tube may be a transmissive field emission X-ray tube. Emitting electrons from the field emission emitter 120 of the cathode electrode 110 and focusing electron beams those are arrows shown in the drawing are performed by an electric field, and the gate electrode 130 and the focusing electrode 140 perform the emission of electrons and focusing electron beams. The cathode electrode 110 may include a metal. The field emission emitter may include nanomaterials such as carbon nano-tubes. The gate electrode 130 and the focusing electrode 140 may include metallic materials such as Aluminum Al, stainless steel, and a Kobar alloy.

Structure and size of the vacuum container 150 of the field emission X-ray tube and locations and sizes of the gate electrode 130 and the focusing electrode 140 may vary with purposes of the electron beams. The vacuum container 150 may include an insulating material such as ceramic. A vacuum seaming method for manufacturing the field emission X-ray tube may use a brazing method and frit that is a chemical adhesion material.

A gate electrode formed in a mesh shape provided inside the vacuum container 150 is used for a general field emission X-ray tube. On the contrary, the gate electrode 130 may have a shape with one opening. Since emission of electrons e from the field emission emitter 120 of the cathode electrode 110 is performed by an electric field, the gate electrode 130 may emit electrons e using only one opening.

General reflective field emission X-ray tubes generate X-rays when the electron beams emitted from the field emission emitter 120 that is an electron source are focused on and collide with the anode electrode 160 inclined with a certain angle. The anode electrode 160 may include polycrystalline and/or single-crystal metals such as tungsten W, molybdenum Mo, and copper Cu. To allow the field emission X-ray tube to generate X-rays with high output characteristics, the anode electrode 160 may include a single-crystal metal.

FIGS. 2 to 5 are three-dimensional views illustrating a partial configuration of the field emission X-ray tubes according to the embodiments.

Referring to FIGS. 2 to 5, a bonding-structure electrode 200 may include the gate electrode 130 including a first opening (refer to 135 in FIG. 1), and the focusing electrode 140 including a second opening (refer to 145 in FIG. 1) having a greater width than the first opening. The focusing electrode 140 may be a form in physical contact with one surface of the gate electrode 130. The gate electrode 130 and the focusing electrode 140 may be electrically, chemically, and physically connected to each other. An outer circumference of the focusing electrode 140 may be the same as that of the gate electrode 130 or less. Preferably, the focusing electrode 140 of the bonding structure electrode 200 may have a smaller outer circumference than that of the gate electrode 130.

A cross-section of the first opening of the gate electrode 130 may be a circle or a polygon. Preferably, the cross-section of the first opening according to the present embodiment may be a concentric circle. The first opening may have a shape penetrating the gate electrode 130. A cross-section of the second opening may be a circle or polygon. Preferably, the cross-section of the second opening according to the present embodiment may be a concentric circle, an oval, or a quadrangle. The second opening may have a shape penetrating the focusing electrode 140.

The first opening of the gate electrode 130 may have a greater width than a maximum width of the field emission emitter 120. The width of the first opening may not allow field-emitted electron beams to be induced to an edge of the first opening. This is for preventing a great increase of a leakage current caused by inducing electron beams to the edge of the first opening. The thinner thickness of the gate electrode 130 the better. However, the gate electrode 130 may have a thickness capable of preventing a vibration occurring due to an applied voltage.

The second opening of the focusing electrode 140 may be manufactured to have a greater width than that of the first opening considering that the electron beams passing through the first opening radially spread out. This may be for naturally focusing the electron beams in a triangular shape as shown in FIG. 1 by allowing the electron beams to face an equipotential section with a wider area at a point in time when the electron beams getting out of a narrow area to which a certain voltage is applied radially spread out.

Figure 6:
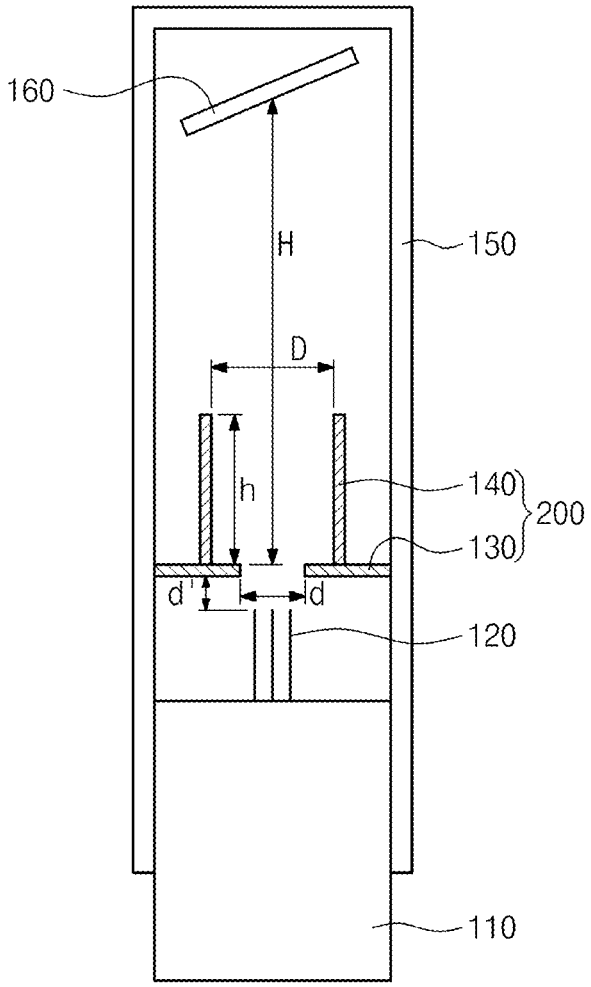
FIG. 6 is a cross-sectional view illustrating the configuration of the field emission X-ray tube according to the present embodiment.

FIG. 6 is a cross-sectional view illustrating a configuration of the field emission X-ray tube according to the present, and FIGS. 7 to 10 are concept views illustrating a method of focusing electron beams by using the field emission X-ray tube according to the present embodiment.

Referring to FIG. 6, as shown therein, a distance between the gate electrode 120 and the anode electrode 160 may be shown as H, the height of the focusing electrode 140 may be shown as h, the width of an opening (refer to 145 of FIG. 1) of the focusing electrode 140 may be shown as D, the width of an opening (refer to 135 of FIG. 1) of the gate electrode 140 may be shown as d, and a distance between the field emission emitter 120 and the gate electrode 130 may be shown as d'.

Figure 7:
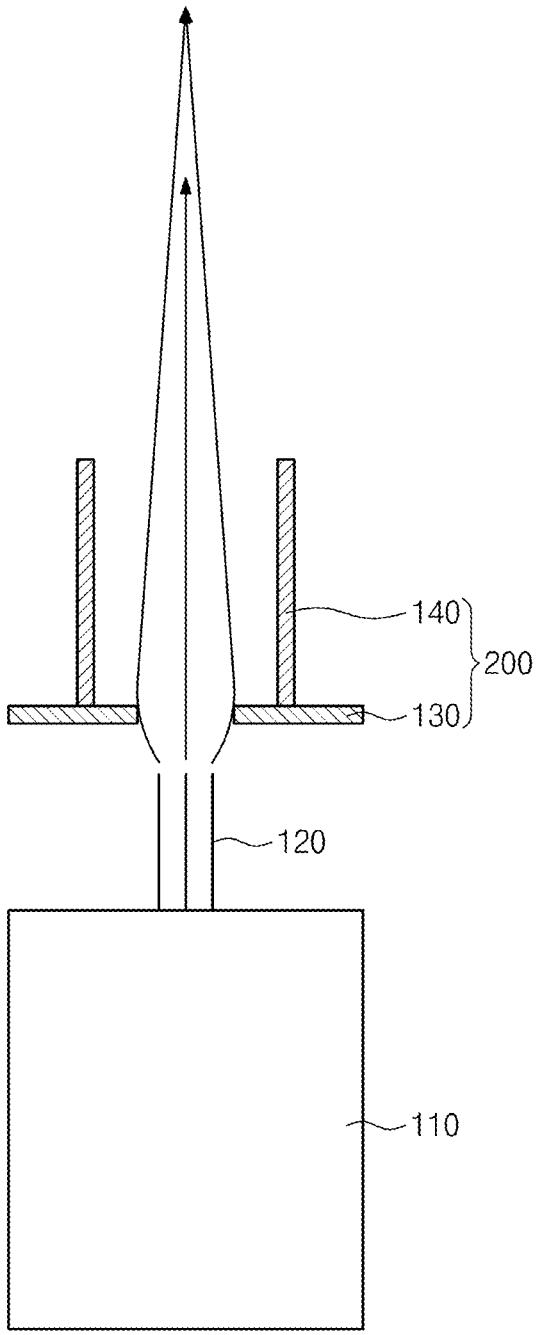
FIGS. 7 to 10 are concept views illustrating a method of focusing electron beams by using the field emission X-ray tube according to the present embodiment.

Referring to FIGS. 6 and 7, when D and h are identical to each other and d is ⅓ or less of D, electron beams may be focused to form a minimum spot on the anode electrode 160 without charge accumulation.

Figure 8:
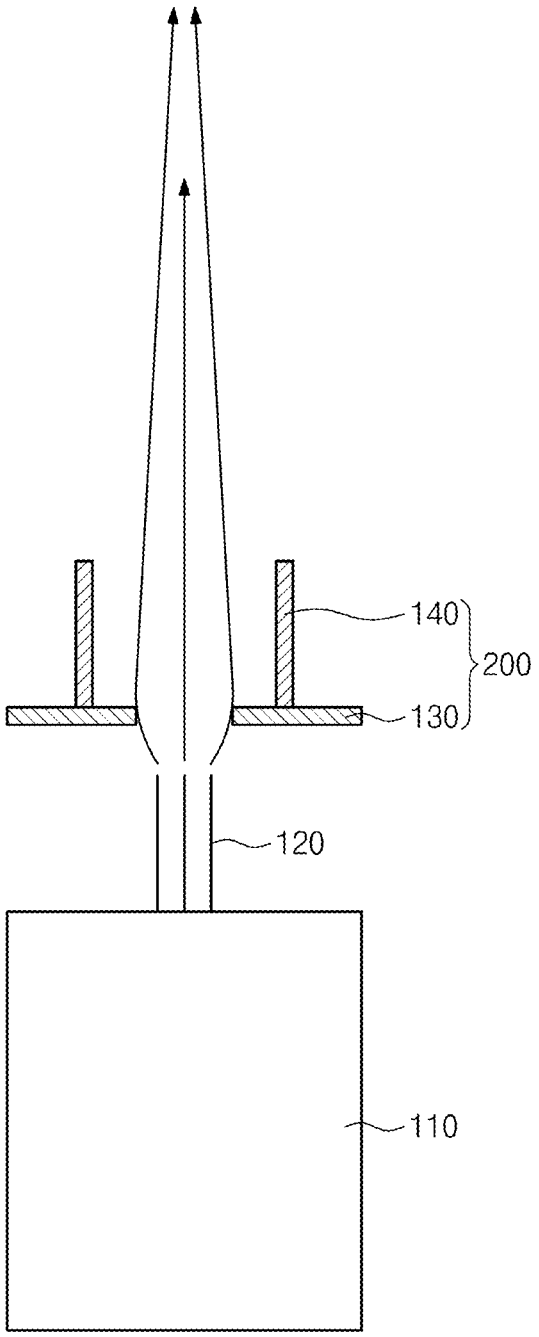

Referring to FIGS. 6 and 8, when changing h while D>h, a spot is formed in a size as d. Also, not shown, when D<h, a minimum spot is formed before arriving the anode electrode 160 and the electron beams radially collide with the anode electrode 160.

Figure 9:
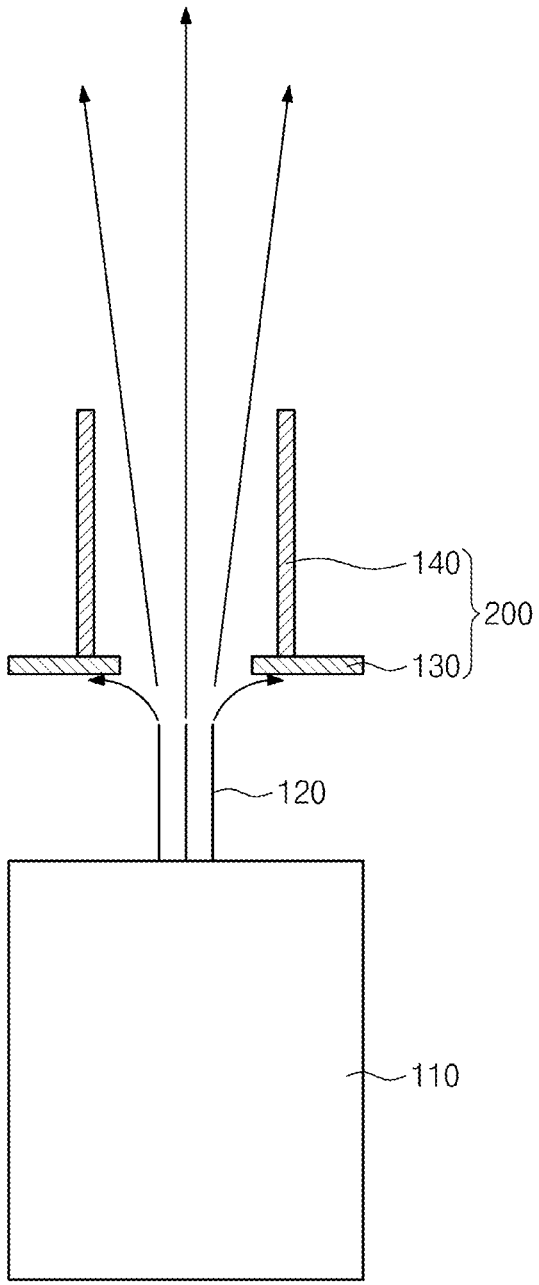

Referring to FIGS. 6 and 9, when changing d while D is being identical to h, a spot is formed in a size of d as shown in FIG. 8 when it is controlled that d is to be more than ⅓ of D, and not shown, the electron beams are induced to an edge of the opening of the gate electrode 130 to increase a leakage current and radially collide with the anode electrode 160 to form a great spot when it is controlled that d is to be close to a maximum width of the cross-section of the field emission emitter 120.

Figure 10:
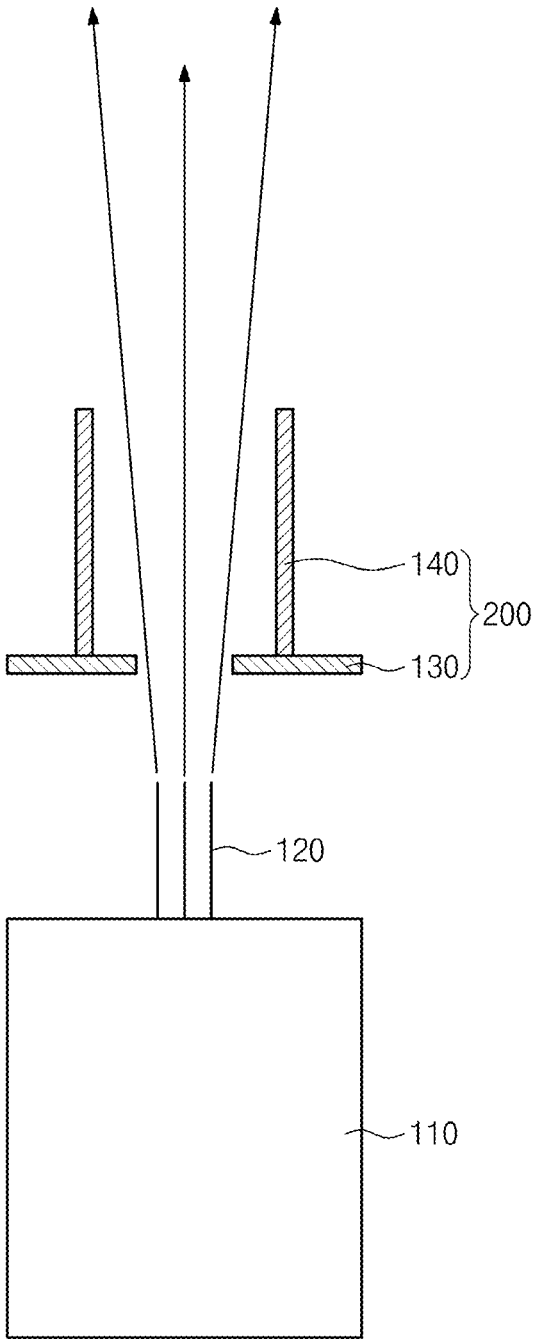

Referring to FIGS. 6 and 10, when changing d', a minimum spot is formed when it is controlled that the gate electrode 130 is to be far from the field emission emitter 120 but a voltage applied to the focusing electrode 130 should be increased in this case. Also, not shown, when it is controlled that the gate electrode 130 is to be close to the field emission emitter 120, there are increased electron beams induced to the edge of the gate electrode 130.

As a result thereof, the bonding structure electrode 200 should be inserted inside the vacuum container 150 under a condition of FIG. 7, thereby providing a micro field emission X-ray tube capable of focusing an electron beam spot with low power, with high output, with high resolution, and with a size or micros or less on the anode electrode 160.

The field emission X-ray tube includes a focusing electrode with a height as the same as a width of an opening of the focusing electrode and a gate electrode having an opening with a width of ⅓ or less of the width of the opening of the focusing electrode, thereby focusing electron beams to form a micro-sized or nano-sized spot without charge accumulation. Accordingly, it is possible to provide the field emission X-ray tube capable of preventing charge accumulation simultaneously with forming an electron beam spot with a size of microns or less.

Also, electron beams may be focused to form a micro-sized or nano-sized spot without charge accumulation by controlling the height of the focusing electrode or the width of the gate electrode of the field emission X-ray tube according to the present embodiment. Accordingly, it is possible to an electron beam spot with a size of microns or less on an anode electrode thereby focusing electron beams emitted from a field emission emitter.

As a result thereof, since the filed emission X-ray tube according to the present embodiment is able to prevent a damage and demolition of a filed emission electron source, to reduce power, to minimize a size thereof, to be highly integrated, and to control the strength of X-rays, thereby being applied to industrial systems for inspecting defects and quality of products, medical brachytherapy systems, and three-dimensional digital diagnosis systems.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A field emission X-ray tube comprising:

a cathode electrode provided on one end of a vacuum container, comprising a field emission emitter;

a gate electrode provided inside the vacuum container to be adjacent to the cathode electrode, comprising a first opening;

a focusing electrode electrically connected to the gate electrode and provided on one surface of the gate electrode to be farther from the cathode electrode than the gate electrode while comprising a second opening with a greater width than that of the first opening; and an anode electrode provided inside the vacuum container on another end thereof in a direction where the vacuum container is extended, wherein a height of the focusing electrode is identical to the width of the second opening, and wherein the width of the first opening is ⅓ or less of the second opening.

2. The field emission X-ray tube of claim 1, wherein the focusing electrode is in physical contact with the one surface of the gate electrode.

3. The field emission X-ray tube of claim 1, wherein an outer circumference of the focusing electrode is smaller than that of the gate electrode.

4. The field emission X-ray tube of claim 1, wherein a cross-section of the first opening is one of a circle and a polygon.

5. The field emission X-ray tube of claim 1, wherein the width of the first opening is greater than a maximum width of a cross-section of the field emission emitter.

6. The field emission X-ray tube of claim 1, wherein the first opening comprises a shape penetrating the gate electrode.

7. The field emission X-ray tube of claim 1, wherein a cross-section of the field emission emitter is one of a circle and a polygon.

8. The field emission X-ray tube of claim 1, wherein a cross-section of the second opening is one of a circle and a polygon.

9. The field emission X-ray tube of claim 1, wherein the second opening comprises a shape penetrating the focusing electrode.

10. The field emission X-ray tube of claim 1, wherein the field emission emitter comprises nano-materials.

11. The field emission X-ray tube of claim 1, wherein the anode electrode is inclined with respect to the cathode electrode.

12. A method of focusing electron beams using a field emission X-ray tube comprising a cathode electrode provided on one end of a vacuum container, comprising a field emission emitter; a gate electrode provided inside the vacuum container to be adjacent to the cathode electrode, comprising a first opening; a focusing electrode electrically connected to the gate electrode and provided on one surface of the gate electrode to be farther from the cathode electrode than the gate electrode while comprising a second opening with a greater width than that of the first opening; and an anode electrode provided inside the vacuum container on another end thereof in a direction where the vacuum container is extended, wherein a height of the focusing electrode is identical to the width of the second opening, and wherein the width of the first opening is ⅓ or less of the second opening, the method comprising:

one of controlling the height of the focusing electrode and changing the width of the first opening.

13. The method of claim 12, further comprising changing a distance between the field emission emitter and the gate electrode.

14. The method of claim 12, wherein the focusing electrode is in physical contact with the one surface of the gate electrode.

15. The method of claim 12, wherein the anode electrode is inclined with respect to the cathode electrode.

* * * * *